United States Patent [19]

Rilliet

[11] Patent Number: 4,923,072

[45] Date of Patent: May 8, 1990

[54] TUBE, STOPPER AND COMPRESSION RING FOR BLOOD SAMPLING SYSTEMS

[75] Inventor: François Rilliet, Chene-Bougeries, Switzerland

[73] Assignee: Dematex Development & Investment Establishment, Liechtenstein, Liechtenstein

[21] Appl. No.: 324,915

[22] Filed: Mar. 17, 1989

[30] Foreign Application Priority Data

Mar. 25, 1988 [EP] European Pat. Off. ..... 88810201.9

[51] Int. Cl.[5] ..... B65D 47/36

[52] U.S. Cl. ..... 215/247; 215/274

[58] Field of Search ..... 215/247, 274, 320, 272

[56] References Cited

U.S. PATENT DOCUMENTS 1,430,685 10/1922 Sampson ..... 215/274
1,509,916 9/1924 Waite ..... 215/247 X
4,133,441 1/1979 Mittleman et al. ..... 215/247
4,279,353 7/1981 Honma ..... 215/272 X

*Primary Examiner*—Donald F. Norton
*Attorney, Agent, or Firm*—Kane, Dalsimer, Sullivan, Kurucz, Levy, Eisele and Richard

[57] ABSTRACT

An evacuated blood collection tube has a stopper made of deformable synthetic rubber, incorporating a skirt fitting over the outer wall of the tube neck, and integral with the skirt a plug that penetrates the neck of the tube. The sealing function is performed by two embodiments, the upper cylindrical sealing portion of the skirt and the plug. An annular recess surrounds the plug. A compression ring made of a more rigid material is set around the upper peripheral wall of the skirt that overlaps the cylindrical sealing portion. The compression ring cooperates with the rubber stopper and the tube to provide a clenching mechanism ensuring automated guidance of the tube in full sealing engagement over the plug. Furthermore it maintains a constant sealing pressure of the skirt over the tube optimizing vacuum preservation.

15 Claims, 3 Drawing Sheets

TUBE, STOPPER AND COMPRESSION RING FOR BLOOD SAMPLING SYSTEMS

TECHNICAL FIELD

The invention relates to tubes and in particular to evacuated tubes used for the collection of physiological fluids such as blood.

BACKGROUND ART

Conventional evacuated blood collection tubes are known to be made with a rubber stopper penetrating the inside of the tube intended to hold the vacuum and, at the same time prevent escape of the blood content.

Most of the health hazards inherent to these tubes stem from this single sealing concept. The high radial pressure of the stopper against the tube inner wall needed to hold the vacuum results in strong bouncing effect when the stopper is removed. Blood deposits adhering to the sealing surface are dispersed as slashes and aerosols.

Besides these blood dispersal phenomena, handling of these tubes expose the technicians to the risks of contact of the fingers with the large surface of the stopper smeared with blood.

Arrangements have been proposed as an attempt to minimize these problems. One of them consists in plastic caps covering these conventional vacuum tubes rubber bungs. These caps are set over the stopper head and their rigid skirt extends below the head, concentrically to the tube. A free space is provided between the tube wall and the cap to permit handling.

Although minimizing the risk of direct contact of fingers with the stopper walls, these caps did not resolve at all the blood dispersal phenomena, above described. It still is the same type of rubber bung that penetrates the tube to hold both the vacuum and blood so, the same effects of splashes and aerosols are produced which, the open end of the plastic cap totally fails to entrap. Systems cf this type have been described in literature.

Another arrangement presents a stopper made with a rubber skirt fitting over the neck of the tube, and integral with the skirt a plug that penetrates the tube. The sealing function is performed by two separate means mostly, the plug for the blood content and the upper cylindrical sealing portion for vacuum. These two sealing means are separated by an annular recess surrounding the central plug.

The stopper is movable outwardly on the tube from a sealing position to a venting position in which grooves or similar recesses having major axial components communicate the interior of the tube with the exterior (see FIGS. 1 and 2 of European patent No. 0022765). Although this system has improved handling of vacuum tubes, it still presents two major limitations. On the one hand, when the technician restoppers the tube, there is no mechanism which guarantees that the stopper plug is fully engaged inside the tube in the sealing position. The blind skirt fitting over the tube occults the position of the tube rim in relation to the central plug. As a consequence of this lack of visual control, it happens in routine use that the plug being partly engaged only or not engaged in the tube, blood spillage occurs unconspicuously within the system compromising the high standard of hygiene required today by laboratories.

A clenching mechanism would be required to achieve systematic guidance to the complete sealing position.

On the other hand, the pressure of the skirt wall around the tube neck outer wall tends to weaken over the time, due to the stretching condition of the stopper over the tube and to the deformability of the rubber material. As a consequence, vacuum may be lost.

DISCLOSURE OF THE INVENTION

The invention concerns the combination of a vial-type tube, and a stopper, the tube comprising a neck with an open end. The stopper comprises a hollow generally cylindrical body of deformable material having a head including a sealing membrane for fitting over and closing the open end of the tube and, an integral skirt extending from the head for sealibly fitting over the neck of the tube. An annular recess surrounds a protruding central plug of the sealing membrane and, a cylindrical sealing portion which extends from said annular recess beyond the plug is smooth and uninterrupted until it reaches the lower portion of the skirt such that, in the sealing position, the plug sealibly fits in the open end of the tube neck when, simultaneously the cylindrical sealing portion sealibly fits around the tube neck.

An object of the invention is to provide such a combination with a clenching mechanism that achieves automated guidance of the tube to the fully engaged sealing position with the dual-sealing embodiment of the stopper. Furthermore, it is to improve the stability of vacuum inside the tube with the incorporation of a non-deformable element in the sealing system.

The compression ring, usually made of plastic is set on the upper part of the rubber stopper and extends downwardly from the head around the upper part of the peripheral wall of the skirt that overlaps the inner cylindrical sealing portion. At least one annular segment of the inner wall ring fits against said peripheral wall, at a position intermediate between the annular groove and the lower cylindrical sealing portion.

When the tube is introduced inside the stopper, as a result of the compression of the rubber wall between the tube and the outer ring, an annular serration forms on the inner surface of the cylindrical sealing portion, at the interface with the annular groove, against which the tube comes to a stop.

The pressure needed to pass the rim of the tube over the resilient serration ensures that, under the impulse of the force released when the resistance yields, the tube enters the annular groove space and engages in complete sealing position over the central plug.

When the stopper is removed from the tube, the same steps take place but in a reverse manner: once the stopper plug has been disengaged from the neck of the tube and the rim has passed below the annular groove to enter the cylindrical sealing portion, then the annular serration spontaneously forms back over the tube rim. The force thus released by decompression of the elastomer automatically lifts the stopper up to a position where its lower slanted section lies over the tube rim. This permits efficient, convenient one hand manipulation technique.

The combination of the rubber stopper, the tube and the compression ring improves vacuum preservation in two ways. Firstly, the ring maintains the skirt outer diameter and therefore the sealing engagement over the tube wall at a constant level over the time. Secondly, as a result of the compression, the cylindrical sealing portion of the skirt is stretched into a longer segment over the tube neck, thus providing a larger barrier between the interior of the tube and the external environment.

BRIEF DESCRIPTION OF DRAWINGS

Embodiments of the invention will now be described, by way of example, with reference to the accompanying schematic drawings in which.

BEST MODES FOR CARRYING OUT THE INVENTION

Figure 1:
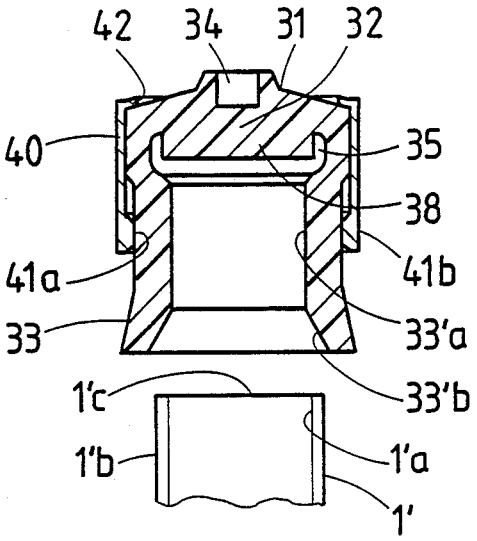
FIG. 1 is a cross section of a first form of stopper inset in the compression ring shown separate from the tube

FIG. 1 shows a tube, a stopper and a compression ring combination of which the tube neck (1') has a smooth cylindrical outer surface, and the stopper consists of a body of deformable material such as synthetic rubber, having a head (31) including a central dimple (34), and an integral skirt (33) extending flush from the generally cylindrical wall of the head. A self-sealing membrane (32) extends from the head as a central plug (38). This central plug is surrounded by an annular recess in the form of an inwardly facing annular groove (35) in the end of the skirt (33) adjacent the head (31).

The inner wall of the skirt (33) is divided into two portions, an upper one (**33'*a*), cylindrical and extending up to the groove (35), which is smooth and uninterrupted and seals around the tube neck (1'), and a lower one (33'*b***) extending to the edge of the skirt.

An outer compression ring (40) made of plastic or similar resilence material is set at the periphery of the head (31) and extends downwardly around the skirt (33) at a level where it overlaps the upper cylindrical sealing portion (**33'*a*), and fits against the peripheral wall (33) by the annular segment (41*a***).

Figure 2:
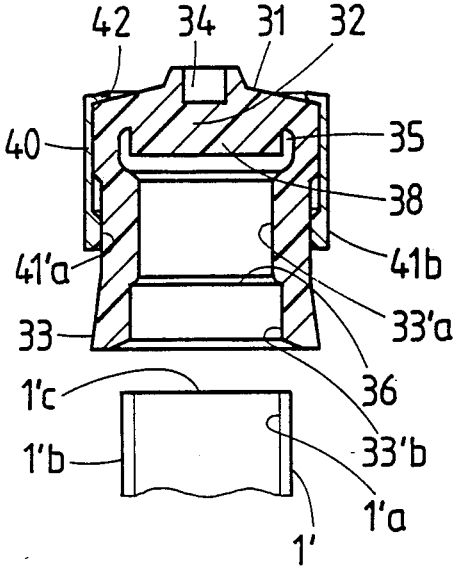
FIG. 2 shows a variation of the embodiment of FIG. 1 in which the inner skirt incorporates two cylindrical portions

FIG. 2 shows a tube,a stopper and a compression ring combination in which the upper cylindrical sealing portion (**33'*a*) is connected to the lower cylindrical portion (33'*b*) of slightly larger diameter by a slanted section (36). The diameter of this upper cylindrical sealing portion (33'*a*) is significantly smaller than the outer diameter of the tube neck (1'**).

Figure 3:
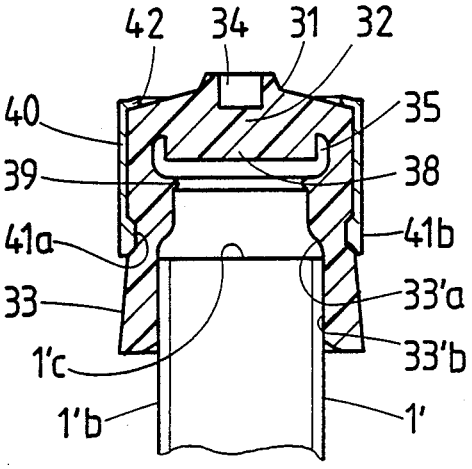
FIGS. 3–4 and 5 show the assembly of the tube to the stopper and compression ring of FIG. 2

FIG. 3 represents the entry of tube (1') inside the sealing portion (**33'*a*) of the stopper of FIG. 2. The thickness of at least one annular segment of the skirt wall (33),overlapped by ring (40),is significantly larger than the breadth of space provided between the two concentric surfaces of the tube outer wall (1'*b*) and the ring inner wall (41*a***).

On penetration of the tube, the ring inner wall (**41*a*) prevents the inherent deformation of the skirt outwardly induced. As a result, the excess material is compressed upwardly and inwardly to form a resilient annular serration (39), at the interface of the annular groove (35) and of the sealing portion (33'*a*), against which the tube rim (1'*c*) comes to a stop, FIG. 4**.

The annular groove (35) extends beyond the plug (38) and provides a deformation space for the annular serration (39) pressed upwardly by the tube rim (**1'*c*), before absorption between the tube wall (1*b*) and the ring (40**).

Figure 5:
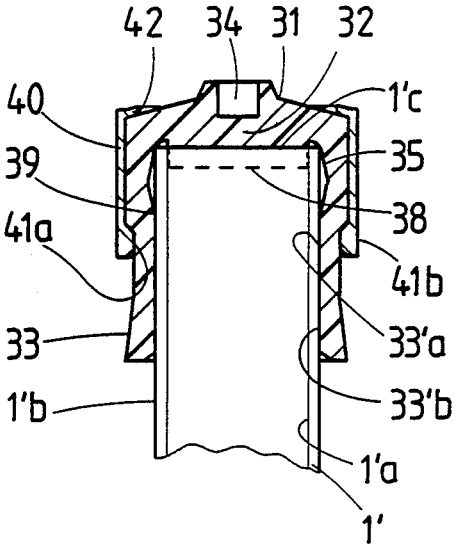

As shown in FIG. 5, the pressure needed to pass the tube rim over the resilient serration (39) is such that, once the resistance yields, under the impulse of the force released the tube enters into the annular recess space (35) and fully engages over the plug (38), achieving the automated clenching mechanism.

Figure 4:
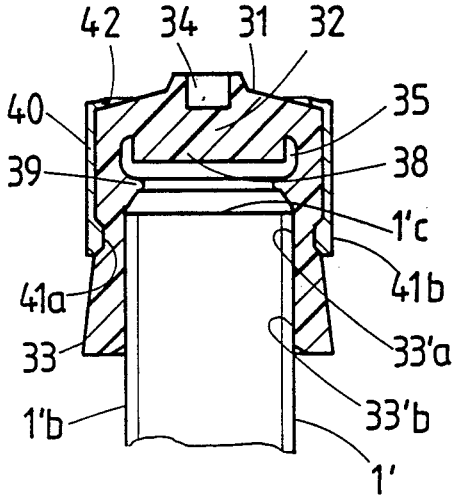

For removing the stopper from the tube, the same steps take place, but in a reverse order as per FIGS. 5–4 and 3. Once the plug (38) has been disengaged and the tube rim (**1'*c*) passed below the annular groove (35), then the annular serration (39) forms back over the tube rim. The force thus released by decompression of the compressed material, automatically lifts the stopper up to a stop position where the slanted section (36) lies above the tube rim (1'*c*). Since the lower portion of the skirt (33'*b***) is uncovered by the ring and freely deformable, the stopper fits in a stable position over the tube permitting a one-hand convenient and efficient manipulation.

Figure 6:
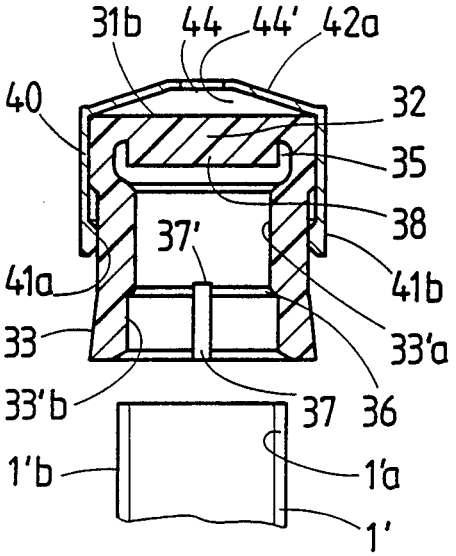
FIG. 6 is a varied form of stopper and compression ring of FIG. 2 in cross-section

FIG. 6 shows a stopper of the same type as that of FIG. 2 in which the lower cylindrical portion (**33'*b*) incorporates an axially directed groove (37),which extends from the skirt edge along this lower portion slightly into the upper portion (33'*a***) which otherwise is smooth and uninterrupted.

The lower annular segment (**41*a*) of the ring stops at distance above the outlet (37'**) of this axial groove.

In the form of realisation of FIG. 6, the ring 40 differs from the previous representations by the abutments (**42*a*) that extend as a cover, radially and inwardly from the peripheral wall of the ring to a central opening (44), acceeding to a chamber (44') defined in its top by said cover (42*a*), and in its bottom by the flat surface (31*b***) of the stopper head.

The cover with the narrow central opening (44) leading into a chamber (44') protects the technician against contact with any trace of blood remaining on the head surface (**31*b*) after the needle has been pulled out from the sealing membrane (32**).

Figure 7:
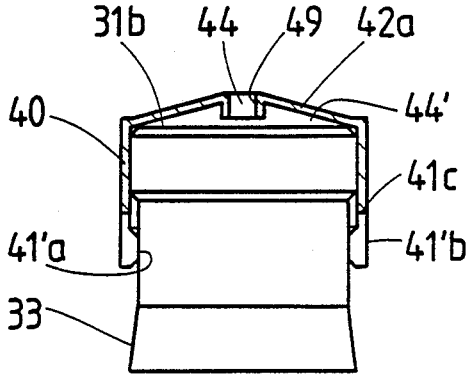
FIG. 7 is a cross section of the compression ring of FIG. 6 with vertical abutments

In FIG. 7, the ring (40) incorporates vertical abutments (49) extending downwardly from the central opening (44) towards the head surface (**31*b*). These abutments are able to transfer a pressure through the membrane (32) to the interior of the tube, when it is necessary to expell a drop of blood from the assembled sampling unit, for instance for making blood slides. In the form of realisation of FIG. 7, the lower edge of the peripheral wall of the ring is provided with at least one axial cut-out (41*c***).

Figure 8:
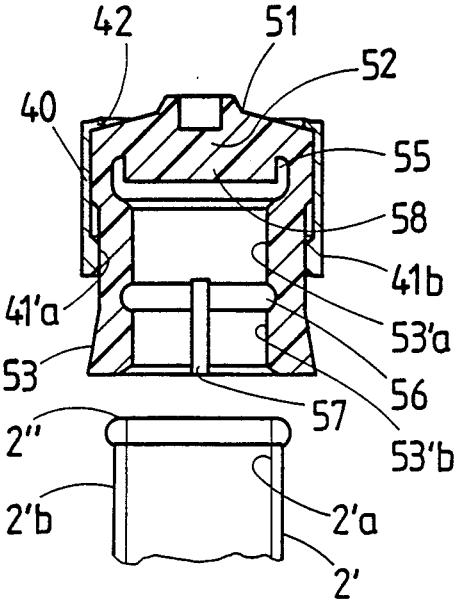
FIG. 8 shows a cross-section of the stopper and compression ring of FIG. 2 adapted to a tube presenting an outwardly protruding annular bead

FIG. 8 shows a tube, a stopper and a compression ring combination in which the tube (2') incorporates an outwardly projecting annular bead (2''), forming a rim on the open end of the tube neck. The skirt (53) is provided with a second annular groove (56) adjacent to the cylindrical sealing portion (**53'*a*) and an axially directed groove (57) extends from the edge of the skirt along this lower portion inner surface slightly into the upper portion (53'*a*). This axially directed groove (57**) has a deeper section than the annular groove at the place they intersect.

Figure 9:
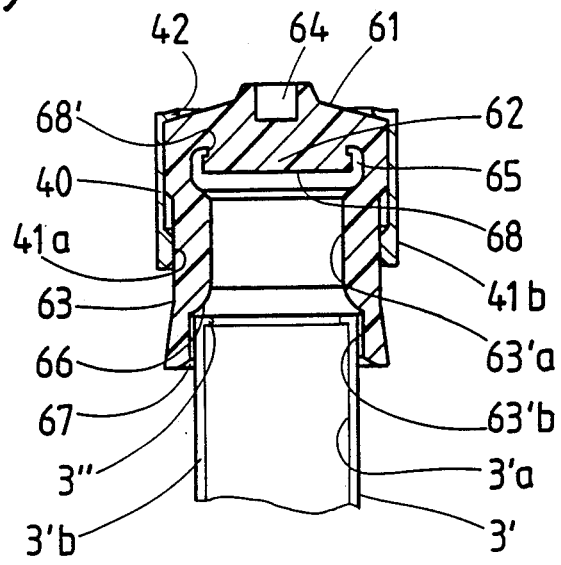
FIG. 9 shows a cross section view of the stopper and compression ring of FIG. 2 adapted to a tube presenting an inwardly protruding annular bead

FIG. 9 shows a form of realisation in which the tube (3') has a rim (3'') slightly protruding as an inward bead at the end of the neck. The stopper has an outwardly flaring groove (68') inset in the periphery of the plug (68) sealibly engaging with the rim (3''). The lower cylindrical portion (63'*b*) of the stopper is larger in diameter than the tube diameter (3'*b*), thus providing a venting recess communicating the interior of the tube with the outside, prior to complete removal of the stopper.

Naturally, many variations may be made to the described embodiments and features of one embodiment may be combined with another embodiment, where appropriate. The term "axially directed groove" is intended to include grooves and similar recesses having major axial components to provide venting space between the tube outer wall and the skirt inner wall, in the lower portion of the skirt adjacent the cylindrical sealing portion.

I claim:

1. In combination, an evacuated vial-type tube and a stopper for the collection of physiological fluids the tube comprising a neck (1') having an open end and the stopper comprising a hollow generally cylindrical body of deformable material, having a head (31) including a sealing membrane (32) and an integral skirt (33) extending from the head (31) for fitting over and around the neck of the tube (1') said stopper having an annular recess (35) surrounding a central protruding plug (38) of the sealing membrane (32), and said skirt having a generally cylindrical sealing portion (33'*a*) which extends from said annular recess (35) beyond the plug (38) and is smooth and uninterrupted until it reaches the lower portion (33'*b*) of the skirts such that in the sealing position it sealibly fits against the tube outer wall (1'*b*) of the tube neck when, simultaneously said plug (38) fits against the inner wall (1'*a*) of the tube neck, said tube being characterized by an outer compression ring (40) made of a more rigid material, having two open ends and being set on the upper part of the stopper and extending downwardly from the head around the upper part of the peripheral wall (33) of the stopper that overlaps said cylindrical sealing portion (33'*a*), said ring presenting on its inner surface at least one annular segment (41*a*) that fits against said peripheral wall (33) of the skirt, at a position intermediate between the upper part of the annular recess (35) and the lower part of the sealing portion (33'*a*).

2. Tube, stopper and compression ring according to claim 1, in which the upper cylindrical sealing portion (33'*a*) of the skirt (33), overlapped by the ring (40), has a walla thickness superior to the breadth of space provided between the two concentric walls of the tube (1') and of the annular segment (41*a*) of the ring, when the skirt is in unstressed prior to the introduction of the tube neck.

3. Tube, stopper and compression ring according to claim 1, in which said annular recess (35) is in the form of an inwardly facing annular groove in the end part of the skirt, said groove extending beyond the plug (38).

4. Tube, stopper and compression ring according to claim 3, in which the diameter of the stopper plug (38) is greater or equal to the diameter of the sealing portion (33'*a*) of the skirt, when the skirt is unstressed prior to introduction of the tube neck.

5. Tube, stopper and compression ring according to claim 1, in which the upper peripheral wall of the ring (40) is provided with abutments (42) lying on the surface of the larger diameter head (31) of the stopper.

6. Tube, stopper and compression ring according to claim 5, in which said abutments extend radially inwardly as a cover (42*a*) from the peripheral wall of the ring to a central opening (44) acceeding to a chamber (44') defined in its top by said cover (42*a*) and in its bottom by the upper surface of the stopper head (31*b*).

7. Tube, stopper and compression ring according to claim 6, in which vertical abutments (49) project downwardly from said cover around the central opening (44) in direction of the stopper head surface (31*b*).

8. Tube, stopper and compression ring according to claim 7, in which the lower edge of the peripheral wall of the ring (40) is provided with at least one axially directed cut-out (41*c*).

9. Tube, stopper and compression ring according to claim 1, in which the stopper (37) presents at least one axially directed recess (37) that extends from the edge of the skirt (33'*b*) at least partly along the inner surface of said skirt until it reaches the lower end of the cylindrical sealing portion (33'*a*)

10. Tube, stopper and compression ring according to claim 9, in which the inner surface of the skirt comprises first and second cylindrical portions, a generally uninterrupted first sealing portion (33'*a*) adjacent the head of the stopper, said first sealing portion at most being interrupted only partly by the end part of an axially directed groove (37), and a second cylindrical portion (33'*b*) of greater diameter than said first portion, said second portion fitting around the tube neck and extending from adjacent said first portion to the edge of the skirt and being interrupted by said axially directed groove (37)

11. Tube, stopper and compression ring according to claim 9, in which the tube (2') comprises an outwardly protruding annular bead (2'') on the end of its neck and said annular inwardly facing groove is configured in cross section to receive therein said annular bead (2'') on the neck of the tube to provide a sealing fit.

12. Tube, stopper and compression ring according to claim 9, in which said annular recess (35) is an annular groove and in which said annular groove or at least one further annular groove intersects with one axially directed groove (57), whereby when the stopper is pulled out from the sealing position until the open end of the tube engages in said annular groove the stopper is held in venting position.

13. Tube, stopper and compression ring according to claim 1 in which the stopper (51) comprises at least one further circumferential annular groove (56) in the inner surface of the skirt (53).

14. Tube, stopper and compression ring according to claim 1 in which the stopper(61)presents at least one annular segment of the lower cylindrical portion (63'*b*) above the edge of the skirt that is larger than the outer diameter of the tube (3'), providing a venting recess (67) between said outer wall and the inner skirt surface, communicating the inside of the tube with the outside before complete removal of the stopper from the tube.

15. Tube, stopper and compression ring according to claim 1, in which the tube neck has a smooth cylindrical outer surface and a rim (3'') protruding inwardly from the open end of the neck, the stopper plug having on its peripheral surface an outwardly facing groove (68') configured in cross section to receive therein said inwardly protruding rim of the tube neck when the stopper is in the sealing position.

* * * * *